United States Patent [19]

Parrish

[11] 4,431,055

[45] Feb. 14, 1984

[54] METHOD FOR SELECTIVE PLUGGING OF DEPLETED CHANNELS OR ZONES IN IN SITU OIL SHALE RETORTS

[75] Inventor: David R. Parrish, Tulsa, Okla.

[73] Assignee: Standard Oil Company (Indiana), Chicago, Ill.

[21] Appl. No.: 276,482

[22] Filed: Jun. 23, 1981

Related U.S. Application Data

[63] Continuation-in-part of Ser. No. 119,085, Feb. 6, 1980, abandoned.

[51] Int. Cl.[3] ..... E21B 43/247; E21B 47/00

[52] U.S. Cl. ..... 166/251; 166/261; 166/292

[58] Field of Search ..... 166/256, 259, 261, 288, 166/292, 251; 299/2

[56] References Cited

U.S. PATENT DOCUMENTS

| | | | |
|---|---|---|---|
| 3,145,772 | 8/1964 | Huitt | 166/251 |
| 3,198,249 | 8/1965 | Willman | 166/251 |
| 3,223,158 | 12/1965 | Baker | 166/259 |
| 3,228,468 | 1/1966 | Nichols | 166/259 |
| 3,291,215 | 12/1966 | Nichols | 166/259 |
| 3,316,020 | 4/1967 | Bergstrom | 166/259 X |
| 3,513,913 | 5/1970 | Bruist | 166/259 X |
| 3,630,278 | 12/1971 | Parker | 166/259 |
| 4,031,956 | 6/1977 | Terry | 166/261 |
| 4,037,657 | 7/1977 | Lekas | 166/259 X |
| 4,063,780 | 12/1977 | Zvejnieks | 166/259 X |
| 4,074,757 | 2/1978 | Felber et al. | 166/261 |
| 4,096,912 | 6/1978 | Lewis et al. | 166/261 X |
| 4,120,354 | 10/1978 | Ridley et al. | 166/251 |
| 4,120,355 | 10/1978 | Knepper et al. | 166/259 |
| 4,200,336 | 4/1980 | Burton | 299/2 |
| 4,243,101 | 1/1981 | Grupping | 166/261 |
| 4,274,487 | 6/1981 | Hollingsworth et al. | 166/261 |

*Primary Examiner*—George A. Suchfield

*Attorney, Agent, or Firm*—Thomas W. Tolpin; William T. McClain; William H. Magidson

[57] ABSTRACT

Depleted zones or channels in in situ retorts that bypass unretorted zones can be plugged selectively by contacting the depleted zones in the in situ oil shale retort with an aqueous liquid, substantially free of a formation plugging amount of a solute, to increase the resistance of the depleted zone or channel to the passage of retorting gases.

4 Claims, 3 Drawing Figures

METHOD FOR SELECTIVE PLUGGING OF DEPLETED CHANNELS OR ZONES IN IN SITU OIL SHALE RETORTS

CROSS-REFERENCES TO RELATED APPLICATIONS

This application is a continuation-in-part of U.S. patent application, Ser. No. 119,085, filed Feb. 6, 1980, now abandoned.

BACKGROUND OF THE INVENTION

This invention relates to the recovery of hydrocarbons from oil shale. More particularly, this invention relates to a process for providing substantially complete removal of recoverable hydrocarbons from oil shale retorts by plugging channels that bypass unretorted shale.

Oil shale refers to deposits of sedimentary rocks containing an organic material called kerogen from which hydrocarbons can be recovered by heat treatment. Shale oil commonly includes the liquid hydrocarbon product recovered upon the heating of oil shale to sufficient temperature to decompose kerogen, forming liquid shale oil hydrocarbons and coke residue. Oil (Kerogen-bearing) shale can be found throughout the world and in particular in Colorado, Utah, and Wyoming.

Commonly, in in situ retorting the shale is heated with hot retorting gas to decompose the kerogen. Since naturally occurring oil shale deposits are substantially impermeable to gases, the shale cannot be heated easily by hot retorting gases. Commonly, prior to retorting, the shale is cracked or broken in such a way that the shale becomes permeable to retorting gases. Many methods including hydraulic fracturing, mining, electrical heating, explosive rubblizing etc. have been proposed to provide permeability and porosity in oil shale retorts. For example a retort or retorting zone containing rubblized shale can be formed beneath the ground, preferably wholly within an oil shale zone by using conventional mining techniques to remove a portion of the shale within a retorting area, preferably at the bottom of the zone. This mined area is called a void space. The balance of the shale is then rubblized, and the rubblized shale is expanded into the void space. The rubblizing provides a permeable, porous shale mass filling the zone. Explosives can be used to rubblize the shale, preferably forming a volume having rubble with uniform particle size wholly enclosed by surrounding solid unrubblized rock walls. M. Prats et al. Soluble-Salt Process For In Situ Recovery of Hydrocarbons From Oil Shale, Journal of Petroleum Technology, September 1977, pages 1078–1088, teaches the use of water to provide permeability in in situ oil shale retorts. The water, by dissolving soluble salt such as sodium carbonate and sodium bicarbonate can introduce very high permeability in the shale as the leached pore volume is large and connected. However, Prats also teaches that fine shale particles produced by the leaching action can reduce the injectability of water causing low permeability. Since this article deals with the production of permeability there is no teaching of the use of fluids to plug depleted zones or channels in retorts.

After the underground retort zone containing rubblized porous shale is formed, hot gases are passed through the rubblized shale to effectively heat and decompose the kerogen and in some cases to aid in the removal of liquid hydrocarbon product. Commonly a gas such as air or air mixed with steam or a fuel such as hydrocarbons is passed through the rubblized zone while igniting the retort to heat the shale. Most commonly, an oxygen containing gas or air is pumped into one end of the retort to support the burning of a portion of the kerogen or the shale forming a flame front throughout an entire end of the shale retort. The flame front passes slowly through the rubblized porous shale body producing hot gasses used to heat the kerogen, resulting in liquid products and coke residue in the rubble. The liquid product can be collected in various places in the retort.

The flame front should proceed uniformly throughout the rubblized oil shale evenly heating the entire zone to insure maximum recovery. In this way, the maximum amount of liquid hydrocarbons would be recovered and little unheated, unretorted shale would remain in the retort. In practice, however, the uniform passage of the flame front through the rubblized shale is an ideal not ordinarily achieved. Since it is impossible to produce rubblized shale with constant particle size, an even distribution of particle sizes, an even distribution of bulk densities, and without void spaces, the flame front cannot pass uniformly through the rubblized shale. One or more portions of the flame front can proceed more rapidly through certain portions of the less dense rubblized shale than through other portions. As one or more portions of the flame front move more rapidly through the retort, a zone or channel of shale which has been retorted and depleted of liquid hydrocarbons can be formed entirely from one end of the retort to another providing a low resistance path through the retort for the retorting gases. This depleted zone or channel causes the retorting gases to bypass a substantial portion of the unretorted shale that is somewhat more dense than the depleted zones. Since these depleted zones or channels provide a relatively low resistance path for the retorting gases, the unretorted shale would remain bypassed, unretorted and unheated, unless the channels or depleted zones are plugged, resulting in the loss of a substantial amount of hydrocarbon.

Willman U.S. Pat. No. 3,198,249 teaches injecting a bank of dissolved solids into a burned out area to plug the porous formation. Willman teaches that the solid residue left by the bank acts to plug void spaces in the formation. Willman suffers the disadvantage that substantial expense would be incurred in injecting sufficient solids into a formation to result in substantial plugging. Further the solids would tend to plug the entire formation.

Thus a need exists to provide a process that insures the production of the maximum amount of recoverable, extractable hydrocarbons from in situ retorts by plugging or sealing depleted zones or channels which occur during the retorting of oil shale.

SUMMARY OF THE INVENTION

The primary object of the invention is to selectively plug depleted zones or channels in in situ retorts to maximize production of recoverable shale oil I have discovered that by contacting a depleted zone or channel with a liquid, such as an aqueous liquid, substantially free from a formation plugging amount of solute, the resistance to the flow of gases through the depleted zone or channel is substantially increased. The zone or channel is plugged or sealed by small particles of rock produced by the action of the liquid on the rock of the zone or channel. I have also discovered that by contacting a depleted zone or channel with a liquid, free from a formation plugging amount of a solute, at a substantially different temperature than the zone or channel, the resistance to the flow of gases is substantially increased by the thermal action of the fluid. By making the depleted zones more resistant to the flow of retorting gases, the gases are forced through the bypassed, unheated and unretorted zones in the oil shale retort which have resistance to the flow of retorting gas less than that of the plugged channels.

One aspect of the invention is a process for selectively plugging a depleted zone or channel in an in situ retort to the flow of retorting gases by increasing the resistance of the zone or channel to the flow of retorting gases which comprises contacting the depleted zone in an oil shale retort with a liquid substantially free of a formation plugging concentration of a solute. A second aspect of the invention is a process for selectively plugging depleted zones or channels in in situ oil shale retorts to the flow of heated retorting gases which comprises forming an in situ retort, initiating combustion in the in situ retort, detecting a depleted zone or channel, contacting the depleted zone or channel with a liquid, free of a formation plugging solute, to increase the resistance of the zone or channel to the flow of retorting gases, and continuing with the retorting of the in situ retort. Another aspect of the invention comprises contacting a depleted zone or channel with a liquid, free of a formation plugging solute, having a temperature substantially lower than the zone or channel.

Briefly, the depleted zones or channels are plugged by contacting shale rock in the zone or channel with a liquid, free of a formation plugging solute, having a temperature substantially equivalent to or less than the zone. The zones or channels are contacted with a formation plugging amount of liquid, free of a formation plugging amount of solute, which comprises an amount of water which will result in sufficient plugging of the zone. Preferably a formation plugging amount of liquid commonly comprises a volume of liquid equal to about 10% of the volume of the retort or greater.

Liquids having about the same temperature as the depleted zones can loosen particulate from the shale by dissolving soluble salts form the shale matrix. Since the action of the liquid removes some of the shale leaving weakened zones of rock having various particle size. The pressure of gas and liquid in the retort causes the crumbled rock to fill cracks and fissures in the zone or channel.

Liquids at a temperature substantially different, preferably substantially lower than the depleted shale causes the shale to crack, split, spall, crumble, etc. by differential thermal expansion, into particles with reduced size, these small particles plug the depleted zones or channels by filling in the cracks in the rubblized shale mass. The difference in temperature between the liquid and the shale causes thermal contraction and expansion. Since the rock is amorphous, different parts of the rock will expand or contract at different rates causing the fracturing and eventual crumbling of the rock. Accordingly the spent shale zone or channel is plugged by the small particles produced by the action of the liquid and becomes less permeable and more resistant to the flow of gases than the unretorted rubblized shale.

Aqueous liquids useful for plugging depleted zones or channels in oil shale generally include aqueous liquids which have a heat capacity sufficient to cause a rapid temperature change in a heated shale zone. If the rate is rapid enough to crack and spall the shale to an extent necessary to provide fines (solid fine particles), the liquid can increase the resistance of the depleted zones to the flow of gases. Examples of aqueous liquids useful in this invention include surface water, process water, connate water underground waters from naturally occurring aquifers, collected rain water, and other natural or artificially produced aqueous liquids. The aqueous liquids used in formation plugging can contain certain, although not formation plugging amounts, dissolved material. Water from natural sources commonly contain as much as 600 ppm of dissolved materials such as mineral solids, gases, organic components, etc. Aqueous liquids can be blended with additives that improve flowability, reduce or increase viscosity, lower drag increase heat capacity, reduce corrosivity, etc. However, the above described solutes commonly do not comprise formation plugging substances, and are not used at concentrations sufficient to plug formations.

In somewhat greater detail, the basic technology for forming underground in situ retorting zones is well known and disclosed in the art. U.S. Pat. Nos. 1,913,395; 1,919,636; 2,481,051; 3,001,776; 3,586,377; 3,434,757; 3,661,423; 3,951,456; and 4,017,911; all of which are incorporated by reference herein, teach methods for forming the in situ retorting zone beneath the ground. Commonly, the recovery of the carbonaceous or hydrocarbon liquids by in situ retorting of oil shale is performed in below ground horizontal or vertical retorts. To form the retorting zones in the modified in situ process a limited undercut is made beneath a large area of overlaying deposits of shale supported by multiplicity of pillars. The pillars can then be removed and the overlaying deposit expanded to fill the void created by the undercut preferably with particles of uniform size, porosity and permeability. Commonly, the overlaying deposit is expanded and rubblized by explosives. This procedure can be repeated in large shale deposits. Communication is then established from the surface to the upper level of the expanded deposit and a high temperature gaseous media which will heat the kerogen and liquefy or vaporize hydrocarbon or carbonaceous products in the shale is introduced in a manner which causes the released hydrocarbon or carbonaceous fluids to flow through or downward through the retort for collection at the base or by any other convenient collection means in the expanded deposit. Hot gases can be created by igniting an end or level of the shale deposit, and forcing the injection of air to cause the flow of hot gases produced by the burning shale downward or through the expanded zone. Commonly, the portions of the kerogen which become liquid products are forced away from the flame front by the gases and are not burned. The portion of kerogen resulting in coked products in the shale is burned producing the heat which drives the retorting.

Commonly, during the combustion phase of retorting oil shale retorts the combustion can proceed through narrow zones or channels leaving a large portion of the shale unretorted. These narrow depleted zones or channels can occur in any part of the retort. However, I believe that these zones are more likely to occur either at the perimeter of the retort or in the center of the retort. Commonly, the bulk density of the rubblized shale is lowest at the perimeter of the retort where the explosives leave rubblized shale against the vertical or horizontal wall that defines the rubblized zone.

Communication from the surface to depleted zones or channels which arise in in situ retorting can be provided by establishing means to transport a plugging liquid from the surface into the depleted zones or channels during the construction of the retort. Means to provide communication to the depleted zones can be installed during mining and rubblizing of the in situ retort. Pipes can be put in place in the perimeter and at any end at regular intervals in the retort for the passage of the fluids. Mined shafts, instrument shafts, retorting gas shafts and any other shaft which is used for another purpose during construction of the retort can be used to communicate the fluid.

Alternatively, communication from the surface to the depleted zones can be provided for the passage of liquids into depletion zons after the retort has been in operation for a period of time. Communicating holes can be established to any part of the retort from the surface by vertical drilling or by directionally drilling. Directional drilling is used to provide communication from the surface at a point outside the perimeter of the retort into or through a side of the retort. One method of directional drilling comprises drilling a roughly vertical shaft (or "hole") until at some point the hole is diverted at an angle from the vertical. These drilled holes may be cased or uncased, depending on the type of formation being drilled. However, in many cases of porous rock the holes or shafts are cased. The hole generally extends from the surface or from a drill hole laterally into the retort ending at the perimeter or at some other location within the depleted zone. Commonly, a whipstock has been used to divert the wells. A whipstock consists of a tapered steel wedge which is run to the bottom of the shaft and oriented so that it pushes the bit in a desired direction. A more modern method of directional drilling uses a down-hole motor or turbo drill and a "bent sub". The string consists of a commonly used drilling bit, turbo drill, bent sub, nonmagnetic drill collars and pipe. Drilling with the above mechanism continues until an adequate change in direction is obtained. The mechanism is then removed and a common rotary drilling string is run to continue the drilling at the new angle from the vertical. By using various combinations of weight and rotary speed and by changing the speed and position of the stabilizers in the drill collar the hole can be made to increase, maintain, or reduce in angle or to change direction. These techniques of directional drilling are well known to persons skilled in the art of oil exploration.

Another method of providing communication from the surface to transport liquids into underground retorts and the depleted zones within comprises locating one or more drill holes sufficiently near the retort and explosively blasting that portion of the formation which is in place between the drill hole and the retort zone. This can be done, for example, by drilling a shaft from a few inches to a few feet in diameter in the undisturbed formation outside the perimeter of the retort adjacent to the retort. Generally the size of the hole of the shaft are designed to economically provide access to depleted zones in the shale. Generally communication can be had through a hole which is about 2–12 inches in diameter. The drill hole is located within a distance to the retort such that explosives placed at the bottom of the hole will be able to remove parts of the formation between the bottom of the hole and the perimeter of the retort and the depleted zone. In many cases it may be desirable to locate drill holes so that the hole runs alongside the underground retort for a considerable distance and explosives are placed at various locations to provide multiple communication means with the depleted zone. Generally the drill holes are 2 to about 10 feet from the subterranean in situ retort perimeter. Commercially available industrial explosives can be used which are well known in the art. Communication can also be established by hydraulic fracturing, thus creating fractures from drill hole into retort.

Another method of providing communication from the surface to transport liquids to underground retorts and the depleted zones within comprises locating a mined shaft within proximity of the depleted zone and providing communication between the mined shaft and the depleted zone for the passage of the liquid. Commonly mined shafts and passageways are provided during the subterranean caving and mining during the formation of the in situ retort. The mined shafts are located at the bottom or at one end of the retort so that a substantial amount, from 5 to 50 weight percent, of the shale can be removed. These mined shafts during in situ retorting can be used to pump the liquid into the depleted zones. Alternatively, entirely new shafts can be sunk to an appropriate level and substantially horizontal shafts can be provided to a close proximity with the depleted zones and communication means such as a drill hole can be provided from the mined shaft into the depleted zone for the passage of liquid.

While, preferably the communication means should enter the zone or channel, the proximity of the communication means to the depleted zone or channel is not critical. Once the communication means is within the retort, the low resistance path of the depleted zone tends to cause substantial amounts of liquid to enter the low resistance path. However, preferably, the end of the communication means should contact or be within the depleted zone for maximum plugging with minimum liquid use with minimum effect on other areas in the retort.

In the instance the liquid, substantially free of plugging solute, is contacted with a shale body at elevated temperature, the shale will be at a temperature of about 1,000 to 1,500° F. and greater. The liquid is injected through whatever appropriate communicating means is provided into the spent zone and the fluid is pumped into the spent zone at a pressure and under such conditions that the heat does not force the liquid back to the surface. The liquid contacts the shale in the zone or channel where the solubility of the rock and the difference in temperature spalls and fractures the rock and causes small particles to plug the formation. The small particles are formed by the dissolving action of the fluid and by the rapid heating or cooling of the liquid in contact with the rock. The pressure of the liquid and gases which form force the small particles into porous spaces between shale particles sealing and plugging the channel to the passage of retorting gases. The liquid and gaseous byproducts can pass through any permeable zone remaining in the retort. The gas can be removed in the same manner as combustion gas, and liquids can be removed by pumping in the same manner as the shale oil.

Commonly, by injecting a limited amount of aqueous liquid into a hot retort the temperature of the in situ retort will not be lowered to the extent that combustion cannot be immediately resumed upon injection of additional oxygen containing gases. However, should the combustion zone be extinguished by a substantial amount of water, the retorting can be continued if combustion is reinitiated by a variety of methods well known in the art for reigniting the retort, such as injecting hydrocarbons and other flammable liquids into the zone to reinitiate shale burning to continue retorting.

In the instance the aqueous liquid, substantially free of a plugging solute, is contacted with a shale body having a temperature about the same as the liquid, the liquid can be injected through whatever appropriate communication means is provided into the spent zone and the liquid is pumped into the spent zone at a pressure and rate such that the liquid can solubilize portions of the shale producing crumbling and cracking of the shale matrix. The pressure of the liquid is such that the crumbled rock is driven by the pressure of the liquid into cracks and fissures in the depleted zone. Small particles which are formed by the dissolving action of the liquid are forced into small porous spaces between shale particles, sealing and plugging the channel to the passage of retorting gases. The liquid can pass through any permeable zone remaining in the retort to be collected and removed in any convenient manner.

Commonly, the retorting can be reestablished by a variety of methods well-known in the art such as by injecting hydrocarbons or other flammable liquids or fuels into the zone, igniting the fuels and heating the shale to a proper temperature to initiate burning.

BRIEF DESCRIPTION OF THE DRAWINGS

The FIGS. 1–3 show illustrations of a variety of means of contacting a liquid with a depleted channel or zone within an in situ retort.

DETAILED DESCRIPTION OF THE PREFERRED EMBODIMENTS

Figure 1:
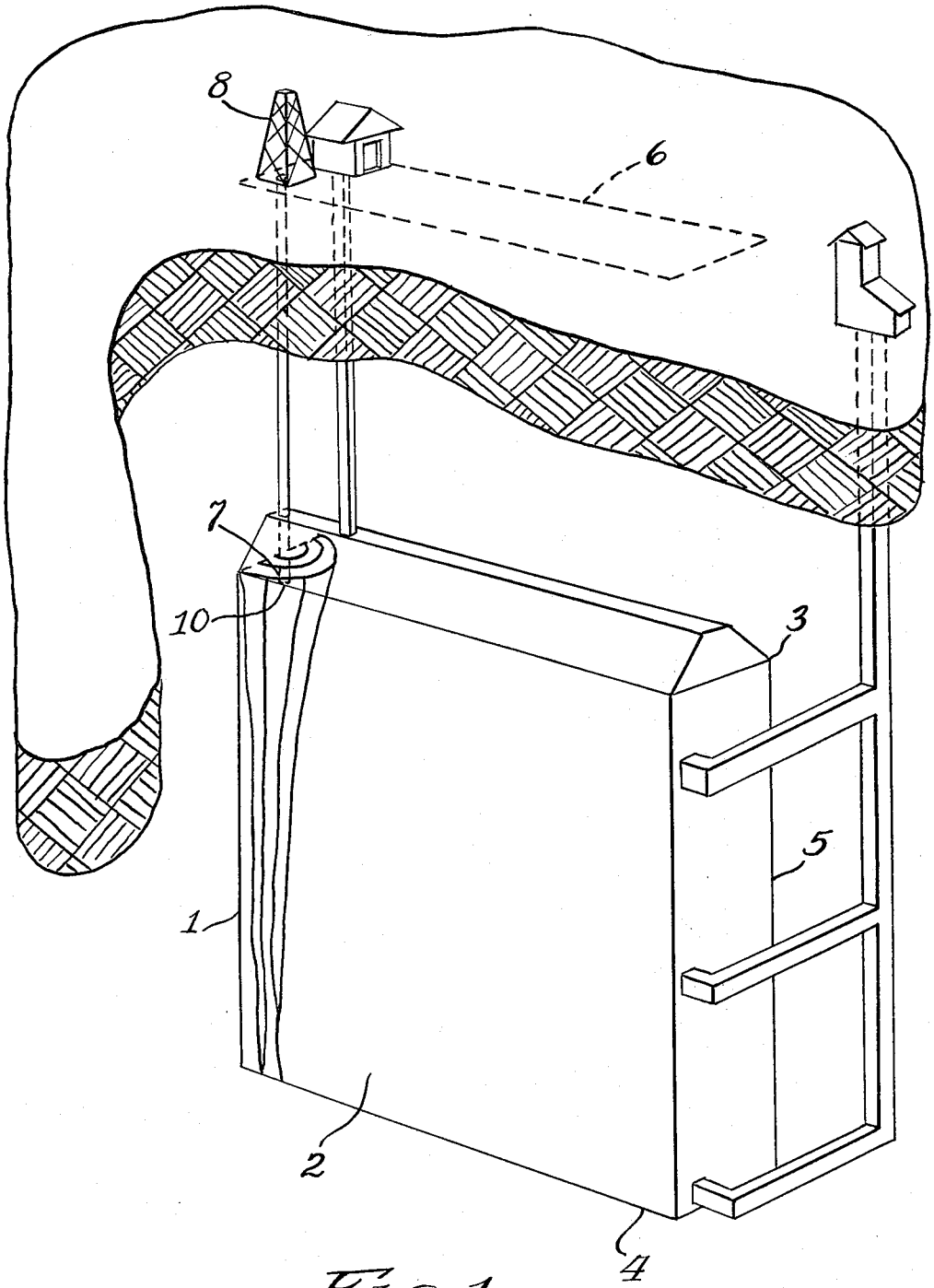

Turning now to FIG. 1, the perimeter of the retort 1 is defined by unrubblized shale walls containing rubblized oil shale body 2. The top 3 and the bottom 4 and the perimeter 5 of the in situ retort can be seen traced on the surface 6. At the top of the retort 3, the shape of the depleted zone or channel 7 is shown. Communication with the depleted zone or channel can be provided by drilling with a drilling rig 8 from above the zone with a pipe 9 directly into the zone 7 penetrating the zone and ending at a point within the zone 10.

Figure 2:
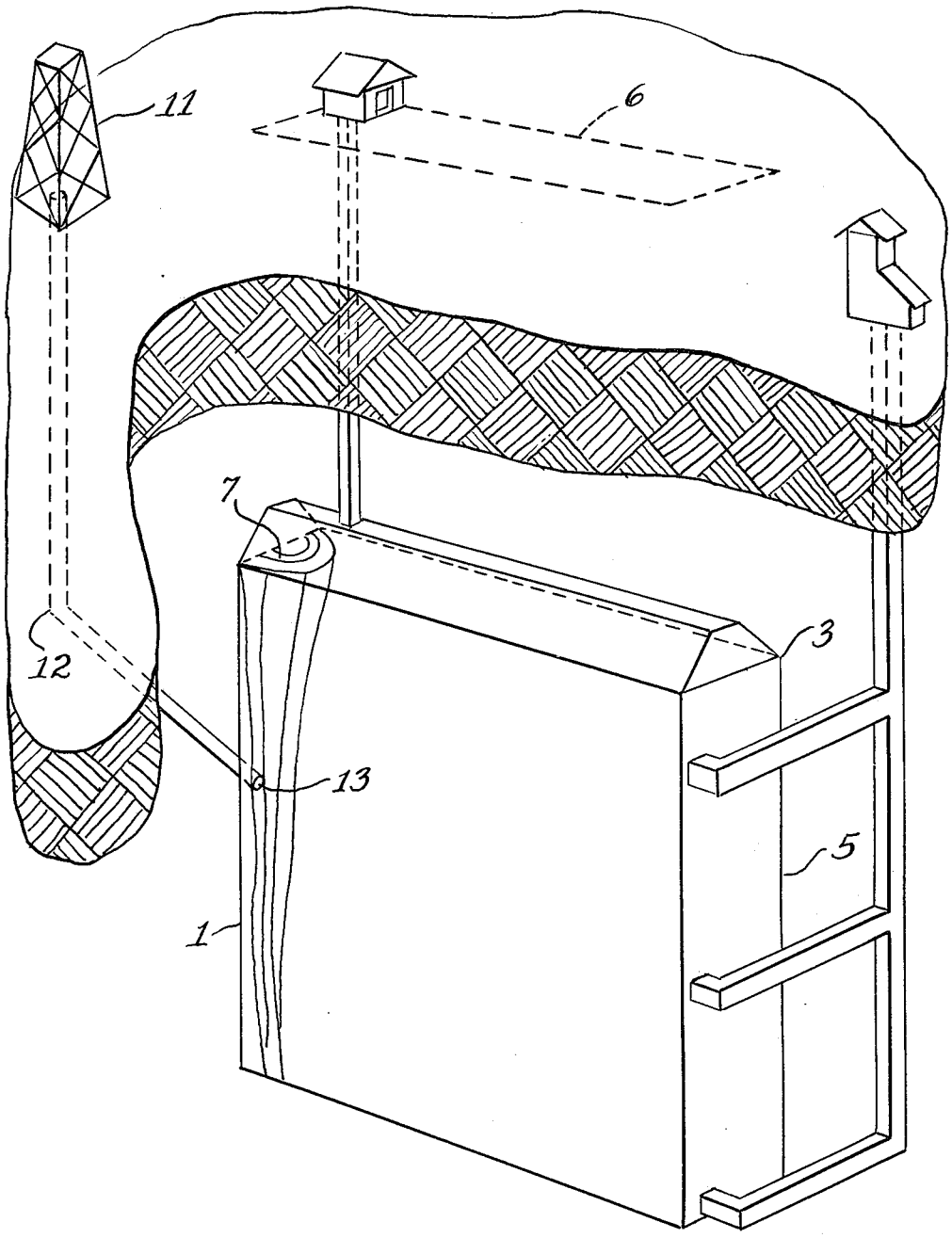

Turning now to FIG. 2, the perimeter of the retort 1 is defined by unrubblized rock walls that contain the rubblized shale 2. The top 3 and the bottom 4 and the perimeter 5 of the retort can be seen traced on the surface 6. The shale of the depleted zone or channel 7 is shown at the top and side of the retort 3. Communication with the depleted zone or channel can be provided by a directional drilling rig 11. The drilling rig 11 provides a vertical shaft to a point 12 where the shaft is diverted from the vertical shaft directly into the depleted zone or channel at point 13.

Figure 3:
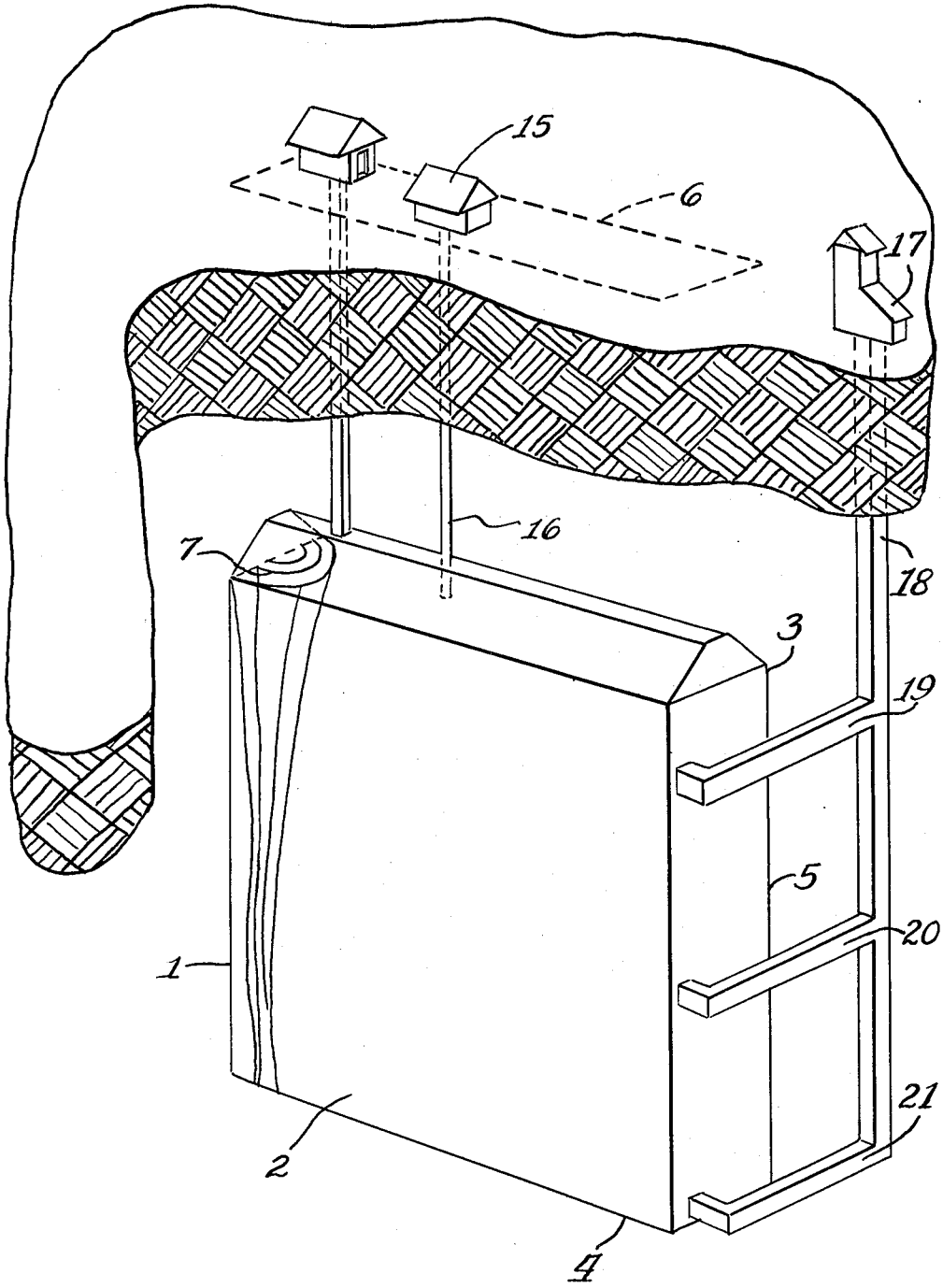

Turning now to FIG. 3, an instrument housing 15 is shown on the surface 6 above the retort 1. An instrument shaft 16 containing means for communicating with sensors in the retort and detection devices in the instrument housing is shown. A liquid for the selective plugging of the depleted zones or channels can be introduced into the retort through instrument shaft 16.

In FIG. 3, a mine shaft housing 17 which covers a mine shaft opening which is used for removing shale during the modified in situ process is shown. Beneath the housing 17 is shown a vertical mine shaft 18 which connects horizontal shafts 19, 20 and 21. These horizontal shafts were used to remove shale and can now be used to communicate selective plugging liquids into the retort at any of a variety of levels.

The following are descriptions of the sequence of events that would occur during the formation, detection, and plugging of a depleted zone or channel in an in situ oil retort.

EXAMPLE I

An underground in situ retort, equipped with thermocouples, and gas sampling devices installed at the retort outlet at various points in the retort, is prepared using the modified in situ method in which the fluid shale oil flows downward to collection points. The retort is ignited, air injection is initiated and the flame front is believed to proceed smoothly through the rubblized shale. The smooth operation of the retort is characterized by the injection of air at moderate pressure and the collection of valuable hydrocarbon products at the outlet. After operation of the retort for a period of time the operators notice certain changes in operating conditions in the retort. Analysis of retort gas effluent shows a small, but slowly increasing amount of oxygen, and the temperature sensors in the retort begin to measure an increase in the temperature of gas effluent. After a period of slow increase in both the oxygen concentration and gas temperature, the temperature of the retort gas quickly increases. The pressure gauges at the retort inlet show a small increase in the pressure required to move combustion air through the retort. After noticing these changes, the operators notice that the oxygen content of the outlet gas would disappear while temperature remains high. Based on production of shale oil, and the known volume of shale and known kerogen content, only a fraction, about 10 vol. %, of the shale oil has been produced.

Assuming that a depleted channel is now present in the oil shale retort the operators inject process water, i.e., water that has been used in chemical processing of oil shale by-products at the surface, into the in situ retort through the air injection mechanism. An amount of water is used to avoid quenching of the retort and to minimize plugging of portions of the retort other than the burned out channel. To do this, an amount of water that could absorb about 10 per cent of the heat remaining in the retort is used. Since about 500 BTU of heat is produced per Standard Cubic foot of oxygen injected (100 BTU per SCF of air), the heat in the retort area is the product of the total injected air volume and 100 BTU or by the product of the total injected oxygen volume and 500 BTU. This quantity of water is pumped into the retort inlet at the maximum rate obtainable without causing a large increase in injection pressure. Within a few hours of the water injection, evidence of steam is detected at the retort outlet. The steam persists until nearly all of the water is injected.

Immediately after the completion of water injection, air injection is resumed. Within three days valuable hydrocarbon products are again being recovered at acceptable rates with no evidence of burning in the outlet. Air injection pressures are somewhat higher, although well within operating parameters.

EXAMPLE II

An in situ retort is formed using the modified in situ method. As in Example I, the operation of the retort proceeds smoothly. At the time that about 50 per cent by volume of the shale oil is recovered, a gradual increase in the oxygen concentration and in the temperature of the retorting gases is noted. After a period of time the temperature increases very rapidly. Since it is often difficult to determine the exact location of the depleted channel or zone, and since an indiscriminate or nonselective injection of water can damage the rubblized shale, preventing the resumption of normal operations, process water is injected into the retort outlet at the bottom of the in situ retorting zone through the shale oil recovery mechanism. An amount of water was chosen so that the water would fill the retort to a depth of about 10 per cent of the height from the bottom of the retort to plug the zone. Immediately after injection, the water is removed from the outlet and air injection is resumed. Reignition is unnecessary, and retorting is normal except that injection pressures are slightly higher than before.

The changes in the operating characteristics of the in situ retorts detailed in Example I is due to the formation of a depleted zone or channel in the retort. When a depleted or burned out channel approaches the retort outlet, some injected air passes through the retort without being consumed in the combustion of kerogen. As the depleted channel nears the retort outlet, the oxygen concentration and temperature of the gas increases since the gas contacts smaller amounts of flammable material and has less time to cool. When the burned out zone or channel reaches the outlet, temperatures increase very rapidly as valuable products begin to burn in the outlet. Upon injecting process water into the retort inlet or outlet, the depleted zone is sealed to passage of retorting gases. The sealing of the depleted zone causes a small increase in the operating pressure since part of the retort is now resistant to the passage of gases.

In Example II, the oxygen concentration and temperature increases in retorting gases is caused by the depleted zone or channel. However, in this case, the water is injected at the bottom of the retort to plug the zone at the bottom. The water never contacts hot shale at the top of the retort. Since the water has little or no effect on unretorted oil shale and has a pronounced effect on plugging the burned or partly burned oil shale in the channel, only the burned shale at the bottom of the retort is affected by water. This mode of operation has the benefit that the shale burning in the upper parts of the retort is not contacted by water and heat is not lost. In this way, the retort as a whole is not affected by the water and reignition is unnecessary.

Clearly, the use of liquids, preferably aqueous liquids substantially free of formation plugging amount of a solute, to plug depleted zones or channels in in situ oil shale retorts will permit retorting a larger portion of the oil shale, will increase the efficiency of the oil shale in situ process by minimizing the amount of air required, will minimize the amount of valuable products burned in the operations, and will increase the amount of shale oil recovered.

Although embodiments of this invention have been shown and described it is to be understood various modifications and substitutions, as well as rearrangements of process steps, can be made by those skilled in the art without departing from the spirit and scope of this invention.

I claim:

1. A process for enhancing the recovery of shale oil from an in situ oil shale retort comprising the steps of:

forming a generally vertical in situ oil shale retort in an underground formation of raw oil shale;

initiating a flame front in an upper portion of the in situ oil shale retort to emit combustion gases defining a heating front;

injecting air into said flame front to support said flame front and drive said combustion gases defining said heating front generally downwardly in said in situ oil shale retort;

retorting a portion of said raw oil shale in said in situ oil shale retort with said heating front to liberate shale oil;

combusting said retorted portion with said flame front leaving a combusted portion defining a depleted zone;

detecting said depleted zone;

substantially plugging said combusted portion defining said depleted zone by injecting an aqueous liquid substantially free of a formation plugging amount of solute into said combusted portion of said in situ oil shale retort defining said depleted zone at a temperature up to the temperature of said combusted portion to crumble at least a portion of said combusted shale in said combusted portion to form fine shale particles which substantially fill cracks in the combusted shale of said depleted zone so as to selectively increase the resistance of said depleted zone to the flow of said combustion gases; and retorting another portion of said raw oil shale in said in situ oil shale retort with said heating front to liberate more shale oil while simultaneously substantially preventing said combustion gases from passing through said plugged portion to enhance the recovery of said shale oil.

2. The process of claim 1 wherein said flame front is extinguished prior to said plugging and reignited after said plugging.

3. The process of claim 1 wherein said aqueous liquid is selected from the group consisting essentially of process water, connate water, surface water, aquifer water, rainwater and combustion gas condensate, and said aqueous liquid is injected into said combustion portion of said in situ oil shale retort at a temperature substantially less than said combusted portion defining said depleted zone.

4. The process of claim 3 wherein the volume of aqueous liquid injected into said combusted portion defining said depleted zone is at least about 10% of the volume of said in situ oil shale retort.

* * * * *